United States Patent [19]

Takemoto et al.

[11] 4,186,756

[45] Feb. 5, 1980

[54] METHOD OF PROCESSING SMOKING COMPOSITION

[75] Inventors: Nagaaki Takemoto; Teruo Sakurai; Kimio Mashiko; Harumatsu Tomari, all of Yokohama, Japan

[73] Assignee: The Japan Tobacco & Salt Public Corporation, Japan

[21] Appl. No.: 802,419

[22] Filed: Jun. 1, 1977

[30] Foreign Application Priority Data

Jun. 15, 1976 [JP] Japan ..... 51-69316

[51] Int. Cl.[2] ..... A24B 3/14; A24D 1/18

[52] U.S. Cl. ..... 131/140 C; 131/2; 131/17 AC

[58] Field of Search ..... 131/2, 17, 140 C, 15 C, 131/140 R

[56] References Cited

U.S. PATENT DOCUMENTS

| | | | |
|---|---|---|---|
| 3,931,824 | 1/1976 | Miano et al. | 131/2 |
| 4,008,773 | 2/1977 | Borthwick | 131/2 |
| 4,109,664 | 8/1978 | Hedge | 131/2 |

OTHER PUBLICATIONS

*The Chemical Composition of Tobacco and Tobacco Smoke* by Stedman Chemical Review, 68:153–207, Apr./1968, p. 190.

*Tobacco and Tobacco Smoke* by Wynder et al., publ. by Academic Press, 1967, New York, USA and London, England, pp. 350 and 234.

*The Chemistry and Technology of Tobacco,* vol. 3, by Shmuk. published by *Pishch Epromizdat,* Moscow, 1953, pp. 602–603.

*Primary Examiner*—V. Millin

*Attorney, Agent, or Firm*—McGlew and Tuttle

[57] ABSTRACT

The smoking composition referring to the reconstituted tobacco or tobacco substitute and composing of natural tobacco material and/or organic or inorganic material(s), which are combustible as raw materials, and of CMC-Na as binder, is heated at 110°–240° C., preferably at 150°–200° C., desirably for 150–5 minutes, so as to reduce the moisture content thereof to 1% and below. The smoking composition thus heating-processed exhibits a markedly superior water-resistance to the smoking composition not heating-processed, while the former exhibits equal physical properties except water-resistance and organoleptic properties to the latter.

17 Claims, No Drawings

METHOD OF PROCESSING SMOKING COMPOSITION

BACKGROUND OF THE INVENTION

1. Field of the Invention

This invention relates to a method of processing smoking composition, more particularly, it relates to the method of processing smoking composition so as to improve the water-resistance of the same for a certain period.

The term "smoking composition" in the present specification and claims refers to a so-called reconstituted tobacco or a tobacco substitute having been prepared by such a method that natural tobacco material and/or organic or inorganic material(s) which are combustible are admixed with binder, humectant, burning regulator, reinforcing agent, flavourant and the like, followed by forming the resultant mixture into a sheet-like or rod-like shape. All percentages and parts in the specification and claims are by weight.

It has hitherto been known several methods for preparing said smoking compositions or reconstituted tobaccos in which natural tobacco material such as tobacco leaf, tobacco dust, tobacco waste or tobacco powder has been used as main raw materials (cf. Japanese patent publication Nos. 25750/1963, 25719/1971, 10040/1972, 10560/1973).

Recently, in view of the smoking-and-health as well as liking of smokers, cigarettes which produce smoke containing less nicotine and tar are rather preferred to those producing smoke containing more such constituents for smokers. Following the above preference of smokers, there have been proposed several preparations of tobacco substitutes in which organic and/or inorganic material(s) that are combustible have been substituted partially or wholly for the natural tobacco material which is the main raw material of reconstituted tobacco (cf. Japanese publication Nos. 27357/1971, 16960/1974).

The above-mentioned smoking compositions, that is, the reconstituted tobacco and tobacco substitute are submitted to the production of cigarettes, pipe tobaccos, cigars and the like (these are hereinafter called "smoking products" in the lump), where said compositions are somewhat humidified and added hydrous solution of suitable additives thereto in order to improve the processability therein and further to improve the organoleptic properties of the smoking products having been made with said compositions.

Thus, the smoking composition which is the main raw material of the smoking products is required to have a considerable water-resistance so that the external shape of the composition will not be broken in the course of said humidifying and addition of hydrous solution of additives, said water-resistance of the smoking composition depending principally on the physical properties of the binders having been used for the preparation of smoking composition.

However, on the other hand, such binders of the smoking composition are needed reversely to be somewhat water-soluble in relation to the processability at the preparation of smoking composition itself using the said binders.

Because of the above-mentioned two requirements of the binder which are inconsistent with each other, the smoking composition prepared using such binder cannot but has comparatively low water-resistance generally, whereby several kinds of troubles have been caused at said humidifying step and the like of the smoking products production.

Water-solubility of the binders of smoking composition such as the cellulose derivatives (ethyl cellulose, methyl cellulose, hydroxy cellulose, carboxymethyl cellulose, etc.) and the starch derivatives (methyl starch, ethyl starch, carboxymethyl starch, hydroxy starch, etc.) depends mainly on the degrees of polymerization and of substitution by ether groups (hereinafter abbreviated to D.P. and D.S respectively), and while, among others, sodium carboxymethyl cellulose (hereinafter abbreviated to CMC-Na) is regarded as the most suitable facility of industrial production thereof, water-solubility and the like, the smoking composition prepared by using CMC-Na has the shortcoming that its water-resistance is lower than those of the compositions prepared by using other binders.

2. The Prior Art

In order to improve generally the water-resistance of smoking composition, there have been proposed several methods in which the cross-linking agents such as glyoxal, dimethylol ureaformaldehyde resin, melamine formaldehyde resin, dialdehyde starch, metallic salts of organic acids or halides have been used together with cellulose derivatives or starch derivatives that have generally been used as binder.

However, the smoking compositions thus prepared by using said cross-linking agents together with the binders have been regarded as to be considerably undesirable in view of the organoleptic properties as well as smoking-and-health of the smoking products prepared therewith.

SUMMARY OF THE INVENTION

We have studied the water-resistance of the smoking composition as mentioned above and found that when the smoking composition in which CMC-Na has been employed as binder is heated at the temperature of 110°-240° C. so as to reduce its moisture content to 1% and below, the water-resistance of the smoking composition is markedly improved hereafter for a certain period, without detorioration of other physical properties than water-resistance and of organoleptic properties thereof.

OBJECTS OF THE INVENTION

Accordingly, an object of the present invention is to provide a method of processing the smoking composition using CMC-Na as a binder to improve the water-resistance thereof for a certain period.

Another object of the invention is to provide a method of processing the smoking composition to improve the water-resistance thereof for a certain period by means of a significantly simple and inexpensive operations.

Still another object of the invention is to provide the smoking composition which may be processed smoothly and without loss of the material at the subsequent production step of smoking products using the said smoking composition.

Still further object of the invention is to provide the smoking composition which is superior to the conventional composition in the water-resistance while is equivalent thereto in other physical properties than water-resistance and organoleptic properties.

The other objects and advantages of the invention will become apparent from the detailed explanation described hereinafter.

DESCRIPTION OF THE INVENTION

According to the processing method of the invention, first, smoking composition are prepared in the routine manner (hereinafter referred to by the term "conventional smoking composition"). That is, natural tobacco material and/or combustible material are pulverized into fine, which fine is admixed with CMC-Na and others and then casted into a sheet-like or rod-like shape, followed by drying of thus casted products. As such casting method of the mixture of main raw material(s) with CMC-Na and others into sheet-like or rod-like shape, the so-called extrusion-, slurry-, paper-, microflake-method and the like, may be adopted. The drying of the sheet or rod is generally operated at the temperature below 100° C. so as to reduce the moisture content of the sheet or rod either to 7–12% that is the general equilibrium moisture content of the same in the atmosphere or to about 5% when moisture-conditioning will be adopted after such drying.

According to the processing method of the invention, the conventional smoking composition prepared as above-mentioned is further heated in the temperature range between 110°–240° C., preferably between 150°–200° C., desirably for 120–5 minutes, particularly for 60–10 minutes so as to reduce the moisture content of the smoking composition to 1% and below, the state of such moisture content of 1% and below being able to be regarded generally as the exhaustively dried one of smoking composition. Heating sources of the above-mentioned heating-process of smoking composition may be steam, hot air, infrared rays, high frequency-wave or microwave.

As for the mutual relation between temperature and time of the heating-process of smoking composition in the present method, it necessarily needs a long time when low temperature has been adopted, while such time may be shortened when high temperature has been adopted. In case of adopting temperature below 110° C., the improvement of water-resistance of the smoking composition becomes insufficient, while in case of temperature above 240° C., the decomposition of CMC-Na is caused whereby the improvement of water-resistance cannot be attained.

Through the heating-process of smoking composition according to the present invention as mentioned above, the water-resistance of the composition is significantly improved hereafter for a certain period. Extent and period of such improvement of water-resistance depend on the chemical structures of CMC-Na used, such as D.P. and D.S., as well as temperature and time of the heating-process of smoking composition.

Table 1 presents values of water-resistance estimated of sheets made of CMC-Na when several kinds of CMC-Na preparations being on the market (mfd. by Daiichi Kogyo Seiyaku Co., Ltd.) and which can be generally applied to binder of particulate materials are formed into sheet-like shape respectively, followed by heat-processing such sheets in the same manner as that of the present invention. Particulars of the procedures of test are as follows: 1–5% CMC-Na aqueous solution is spread, either directly or through an applicator for thin-layer chromatography, on a glass plate, and dried at the temperature of 100° C. in a hot-air drier to the moisture content of about 7%. The sheet-like material of CMC-Na formed on the glass plate is stripped therefrom, and then cut into ribbon-like shape with 1 cm width and 3 cm length so as to prepare the control sample. The control sample is further heating-processed at the temperature of 180° C. for 1 hour in the hot-air drier to reduce the moisture content of the sheet to 0.8%. Said control sample and heating-processed sample are left in the atmosphere of temperature of 20° C. and humidity of 60% for one day to adjust the moisture content thereof to about 10%, and then submitted to the water-resistance estimation. The water-resistance is exhibited by the time (mean of five sample tests) until is cut the sample loaded with a weight of 2.3 g and hung in a water of 20° C. (hereinafter called weight-cutting method). In this test, the control samples of respective CMC-Na preparations have been all cut immediately in 1–2 second(s), so such data of the control samples are described in the lump in only one column of Table 1.

Table 1

| CMC-Na | | | Operative conditions of CMC-Na sheet formation | | |
|---|---|---|---|---|---|
| Trademark | D.S. | D.P. | Cocent. of CMC-Na solution used (%) | Thickness of CMC-Na sheet formed (mm) | Water-resistance of CMC-Na sheet (sec.) |
| Cellogen 5A | 0.7–0.8 | 50 | 5.0 | 0.3–0.4 | 9 |
| Cellogen 6A | 0.7–0.8 | 100 | " | " | 9 |
| Cellogen PR | 0.67 | 250 | " | " | 1800< |
| Cellogen WSA | 0.75 | 400 | " | " | 3600< |
| Cellogen BSH-10 | 0.75 | 850 | 1.0 | 0.1–0.2 | 3600< |
| Cellogen EP | 0.87 | 1000 | 1.7 | 0.3–0.4 | 3600< |
| Cellogen FSV-400 | 0.61 | 750 | 5.0 | 0.1–0.2 | 1800< |
| Cellogen FSB | 0.89 | 400 | " | 0.3–0.4 | 720 |
| AG Gum LV No. 1 | 0.94 | 500 | 2.5 | " | 3600< |
| AG Gum LV No. 2 | 0.81 | 250 | 5.0 | " | 47 |
| AG Gum LV No. 3 | 0.76 | 100 | " | " | 26 |
| Fine Gum SP-6 | 0.72 | 200 | 5.0 | " | 3600< |
| Fine Gum SP-10 | 0.69 | 300 | " | " | 900< |
| Fine Gum SP-150 | 0.62 | 600 | 3.3 | " | 1200< |
| Fine Gum NB-10D | 0.60 | 450 | 5.0 | " | 900< |
| Fine Gum HE-600 | 1.41 | 450 | " | " | 6 |
| Fine Gum SH-50 | 1.50 | 250 | " | " | 50 |
| Control sample | | | | | 2 |

Data of Table 1 reveal that it is, in the method of the present invention, most preferable to use CMC-Na having D.S. of below 1.0 and D.P. of 200–1,000.

Period for which the water-resistance improvement of smoking composition in the method of the present invention is held extends over 2–6 months. Lower the temperature of the heating-process will be (within the said range of 110°–240° C.), the period of water-resistance improvement will be longer (within the said range of 2–6 months). For example, Table 2 demonstrates the data of water-resistance estimated of the smoking composition heating-processed by the present method, when said composition have been left for 14 weeks, the procedure of such leaving test being as follows: The conventional smoking composition prepared in the same manner as that in Example 4 mentioned later is heated at 180° C. for 30 minutes to reduce its moisture content to 0.8%, and, after its moisture content is adjusted to about 7%, said composition is left in the atmosphere of temperature of 20° C. and humidity of 60%, while water-resistance of the composition is estimated at intervals of 1 week. Estimation of water-resistance is conducted by the weight-cutting method mentioned previously and by the shake-breaking method, in which the water-resistance is exhibited by the time (mean of five sample tests) until is broken the circular fragment of 3 cm diameter prepared from the sample and sunk in a water of 30° C., while it is shaken periodically for 5 seconds every one minute with the amplitude of 2 cm and 1 period/second.

Table 2

| | Leaving period of heating-processed smoking compsn. smoking compsn. (week) | | | | | | | | | | Control conventional smoking compsn. |
|---|---|---|---|---|---|---|---|---|---|---|---|
| | 0–4 | 5 | 6 | 7 | 8 | 9 | 10 | 12 | 13 | 14 | |
| Weight-cutting method | above 60 min. | 25 min. | 14 min. | 7 min. | 6 min. | 6 min. | 3 min. | 91 sec. | 27 sec. | 7 sec. | 2 sec. |
| Shake-breaking method | above 30 min. | | | | | | | 19 min. | 9 min. | 4 min. | 1.5 min. |

The improvement of water-resistance of the smoking composition heating-processed by the method of the present invention is, as mentioned previously, maintained in the range of 2–6 months, while the smoking composition is generally submitted, after having been prepared, either immediately or within a short period, to the blending with other tobacco material, followed by the production of smoking products such as cigarettes or pipe tobaccos. Accordingly, when the smoking composition heating-processed by the present invention is submitted to such production of smoking products, the operations can be conducted smoothly without loss of the materials even at the humidifying-step and the like mentioned previously.

On the other hand, though the moisture content of said smoking composition heating-processed returns soon to equilibrium value when it has been left in the atmosphere, it is preferable to make the moisture content of the composition positively to the equilibrium value (7–12%) by humidifying it immediately after the heat-processing. Thus, in the production of smoking products by using the smoking composition prepared by the method of the present invention, it is desirable to adopt the following orders of the progress:

Conventional smoking compsn.→Drying→Heat-processing→Humidifying→Cutting→Chip→Blending→Smoking prods. or, Conventional smoking compsn.→Drying→Cutting→Chip→Heat-processing→Humidifying→Blending→Smoking prods.

The smoking composition heating-processed and moisture-conditioned according to the method of the present invention is equivalent to the conventional smoking composition having not been heating-processed in other physical properties than water-resistance, for example, breaking strength and filling capacity, and in organoleptic properties.

Further, the composition of constituents of smoke which is produced by the smoking of cigarette made of the smoking composition heating-processed by the present invention has also little difference to that of constituents of smoke generated from the conventional smoking composition. Table 3 demonstrates the amounts of constitutents estimated which have been contained in the so-called tobacco main stream smoke and which have hitherto been regarded as being harmful to health, when cigarettes made respectively from the conventional smoking composition (called cigarette by control sample) and from the heating-processed smoking composition (called cigarette by sample of the invention) both of which have been prepared in the similar manner to Example 4 described later, have been smoked, said main stream smoke having been produced by smoking the cigarette periodically for 2 seconds every minute (35 ml a puff) to the butt length of 30 mm.

Table 3

| | Tar mg/cigarette | Cyanide (as HCN) μg/cigarette | Carbon monoxide mg/cigarette | Nitrogen oxide μg/cigarette | Hydrogen sulfide μg/cigarette | Ammonia μg/cigarette | Benzo(a)pyren ng/cigarette |
|---|---|---|---|---|---|---|---|
| Cigarette by control sample | 4.3 | 5.1 | 3.8 | 18 | 96 | 19 | 8.3 |
| Cigarette by sample of the invention | 4.4 | 6.4 | 3.9 | 11 | 75 | 13 | 8.2 |

Conventional smoking composition to be heating-processed in the method of the present invention may be prepared in the routine manner. Amount of CMC-Na to be admixed therewith as binder is, when natural tobacco material is employed as main raw material, 0.5–20.0% (based on the total of all raw materials including CMC-Na; hereinafter the same), preferably 2–10%, while such amount is increased when main raw material(s) other than natural tobacco material are employed. Especially, when the inorganic material(s) are employed as main raw material(s), CMC-Na to be admixed amounts to 10–70%, preferably to 15–50%.

For the preparation of smoking composition, other binders than CMC-Na may also be used together with CMC-Na. Such other binders include cellulose derivatives such as methyl cellulose, ethyl cellulose, hydroxyethyl cellulose, methylhydroxyethyl cellulose and ethylhydroxyethyl cellulose; starch derivatives such as methyl starch, ethyl starch, hydroxyethyl starch and carboxymethyl starch; dextran; gums such as tragacanth gum, locust bean gum, guar gum and gum arabic; alginic acids; pectins and salts thereof; and polyvinyl alcohol.

Furthermore, according to the preferable embodiments of the present invention, several kinds of additives which have hitherto been employed in general for the preparation of the conventional smoking composition may be used. For example, may be used the humectants including glycerin, sorbitol and glycols such as ethyleneglycol, diethyleneglycol, triethyleneglycol, tetraethyleneglycol, propyleneglycol and butyleneglycol; and the burning regulators including alumina, inorganic salts such as potassium salts (potassium nitrate, potassium phosphate, potassium carbonate and the like), ammonium salts and calcium salts. As the reinforcing agents may be employed pulp, glass fibre, silicagel, kieselguhr, asbestos or bentonite, and as the flavourants are used licorice extract, cocoa, tonka bean or fruit extract. Besides the above, in order to improve the taste of the smoking products made of the smoking compositions, may be added thereto saccharides (sucrose, invert sugar, glucose, fructose, lactose, maltose and the like), organic acids (malic acid, citric acid, tartaric acid, acetic acid, lactic acid and the like), salts of said acids or amino acids.

A few of the above-mentioned additives, especially of the flavourants and organic acids have the possibility of being evaporated or decomposed by the heat-processing of smoking composition in the method of the present invention. These additives may be however added to the composition after the latter has been heating-processed by the method of the present invention.

The details of the invention will be illustrated by the following examples, however the descriptions in these examples are not to be considered as limitations, since many changes in the details may be made without departing from the spirit of the invention.

EXAMPLE 1

Eighty (80) parts of tobacco fines prepared by pulverizing the smoking leaf of Nicotiana tabacum var. matsukawa to the dimension of 150 mesh and downward are admixed with 20 parts of pulp (NBKP), 3 parts of CMC-Na having D.S. of 0.7 and D.P. of 400 (with trademark "CELLOGEN WSA"; mfd. by Daiichi Kogyo Seiyaku Co., Ltd.), 1 part of tobacco extract (mfd. by Soda Aromatic Co., Ltd.), 0.5 part of dear tang extract (mfd. by Takasago Perfumery Co., Ltd.), 0.3 part of St. John's Bread extract (mfd. by Ogawa Perfumery Co., Ltd.), 10 parts of propyleneglycol and about 70 parts of water, and after being kneaded, the resultant mixture is spread by passing between rollers having surface temperature of 40° C. to obtain the sheet-like reconstituted tobacco of 0.15 mm thickness, which is then dried in a infrared rays-tunnel-type drier to reduce the moisture content thereof to about 10% (hereinafter called control sample). A portion of the control sample thus obtained is further heated at 170° C. for 20 minutes using a hot-air drier to reduce the moisture content to 0.8% (hereinafter called sample of the invention).

Temperature of the heating-process according to the method of the invention is measured by using the copper-constantan thermocouple of diameter of about 0.5 mm put between two fragments of sample sizing about 2 cm×2 cm each and joined with adhesive agent, such thermocouple having been further placed in about center of the sample to be heated.

The sample of the invention and control sample as mentioned above are moisture-conditioned by holding them in the atmosphere of temperature of 20° C. and humidity of 60% for 3 days, and then submitted respectively to the estimation of water-resistance thereof adopting the shake-breaking method mentioned previously. The data of the test are shown in Table 4.

Table 4

| | Thickness (mm) | Water-resistance (min.) |
|---|---|---|
| Control sample | 0.15 | 1.5 |
| Sample of the invention | 0.145 | 13.2 |

Breaking strength and Filling capacity of these samples are estimated further the data of which are shown in Table 5. The procedures of the above tests are as follows: About 10 g of circular fragment of 3 cm diameter cut from the sample are passed through a breaking strength tester (mfd. by Takara Koki Co., Ltd.; alias Flash Mixer) one by one, and the particles of sample having passed said breaking strength tester are sifted for 5 minutes through a sieve of 14 mesh set in Ro-tap type sieving machine. The breaking strength is represented by the weight ratio of the particles of sample remained in the sieve to the sum of said remained particles of sample and the passed particles of sample through the sieve. On the other hand, the filling capacity which refers to the weight of shredded tobacco wrappable in one cigarette having volume of 3.135 $cm^3$ (g/cigarette) is calculated from the bulk density ($g/cm^3$) measured when 15 g of shredded tobacco of dimension of 10 mm length and 0.8 mm width cut from the sample have been placed in the filling capacity tester (mfd. by Motoyama Engineering Works, Ltd.) followed by pressing them with compressing stress of 250 $g/cm^2$.

Table 5

| | Breaking strength (%) | Filling capacity (g/cigarette) |
|---|---|---|
| Control sample | 91 | 1.02 |
| Sample of the invention | 89 | 0.99 |

Furthermore, Table 6 demonstrates the results of sensory test of the cigarettes made respectively of the control sample and of the sample heating-processed by the method of the present invention. The procedures of the test are carried out as follows: Shredded tobacco prepared in the similar way to that in the above estimation of filling capacity is wrapped into cigarette having 7 cm length and 2.5 cm periphery (without filter tip), and the aroma, taste and mildness of such cigarettes brought when they have been smoked are evaluated, by a panel consisting of ten persons, applying the pair test method, the numbers in Table 6 representing the sum of two times tests.

Table 6

| | Aroma | Taste | Mildness |
|---|---|---|---|
| Number of person(s) who praised cigarette by control sample | 4 | 2 | 4 |

Table 6-continued

| | Aroma | Taste | Mildness |
|---|---|---|---|
| Number of person(s) who praised cigarette by sample of the invention | 1 | 5 | 2 |
| Number of person(s) who found no difference between two cigarettes | 15 | 13 | 14 |

The results of Tables 4–6 mentioned above reveal that the reconstituted tobacco heating-processed by the method of the present invention is significantly superior to the conventional reconstituted tobacco in the water-resistance, and that the former is equivalent to the latter in physical properties except water-resistance, such as breaking strength and filling capacity, as well as organoleptic properties.

EXAMPLE 2

Four (4) parts of 50% glyoxal aqueous solution is added further to the same raw materials of the reconstituted tobacco as those described in Example 1 and the reconstituted tobacco is prepared in the similar operations to those in Example 1 (i.e., control sample).

Using the above control sample and the reconstituted tobacco prepared and heating-processed in the same way as in Example 1 (i.e., sample of the invention), the water-resistance, breaking strength and filling capacity are estimated and the organoleptic properties are evaluated, all in the same way as in Example 1. Results of these tests are shown in Tables 7–9.

Table 7

| | Thickness (mm) | Water-resistance (min.) |
|---|---|---|
| Control sample | 0.14 | 10.2 |
| Sample of the invention | 0.14 | 12.3 |

Table 8

| | Breaking strength (%) | Filling capacity (g/cigarette) |
|---|---|---|
| Control sample | 93 | 1.03 |
| Sample of the invention | 90 | 0.98 |

Table 9

| | Aroma | Taste | Mildness |
|---|---|---|---|
| Number of person(s) who praised cigarette by control sample | 4 | 3 | 5 |
| Number of person(s) who praised cigarette by sample of the invention | 4 | 11 | 9 |
| Number of person(s) who found no difference between two cigarettes | 12 | 6 | 6 |

The results of Tables 7–9 reveal that the reconstituted tobacco heating-processed by the method of the present invention is superior to the reconstituted tobacco the water-resistance of which have especially been improved by employing glyoxal as cross-linking agent together with CMC-Na as binder, in the water-resistance and organoleptic properties, and that the both tobaccos are equivalent to each other in the physical properties except water-resistance, such as breaking strength and filling capacity.

EXAMPLE 3

Sixty (60) parts of cellulose (Toyo Filter Paper No. 2; mfd. by Toyo Roshi Kaisha, Ltd.) are caused to soak 6% aqueous solution of ammonium sulfamate and heated at the temperature of 200° C. for about 3 hrs. in an electric oven. To this are added 20 parts of CMC-Na having D.S. of 0.5 and D.P. of 400 (trademark "CELLOGEN FC"; mfd. by Daiichi Kogyo Seiyaku Co., Ltd.), 25 parts of magnesium carbonate, 20 parts of calcium carbonate, 5 parts of glycerin and about 300 parts of water, so as to make the whole into a slurry state. The slurry is spread on a steel plate in a thickness of about 0.5 mm, and after dried at the temperature of 100° C. in a hot-air drier to reduce the moisture content thereof to about 8%, the spreaded material is stripped from the steel plate to obtain the conventional tobacco substitute (i.e., control sample). A portion of the control sample is heated further at 180° C. for 10 minutes in the hot-air drier to reduce the moisture content to 0.5% (i.e. sample of the invention).

The sample of the invention and control sample are subjected, after being moisture-conditioned, to the tests of water-resistance, breaking strength, filling capacity and organoleptic properties, the results of which tests are shown in Tables 10–12.

Table 10

| | Thickness (mm) | Water-resistance (min.) |
|---|---|---|
| Control sample | 0.11 | 3.2 |
| Sample of the invention | 0.10 | 26.3 |

Table 11

| | Breaking strength (%) | Filling capacity (g/cigarette) |
|---|---|---|
| Control sample | 92 | 0.75 |
| Sample of the invention | 91 | 0.72 |

Table 12

| | Aroma | Taste | Mildness |
|---|---|---|---|
| Number of person(s) who praised cigarette by control sample | 0 | 1 | 2 |
| Number of person(s) who praised cigarette by sample of the invention | 1 | 3 | 2 |
| Number of person(s) who found no difference between no cigarettes | 19 | 16 | 16 |

From the results of Tables 10–12, it is revealed that the tobacco substitute heating-processed by the method of the present invention is significantly superior to the conventional tobacco substitute, in the water-resistance, and that the both tobacco substitutes are equivalent to each other in the physical properties except water-resistance, such as breaking strength and filling capacity, as well as the organoleptic properties.

EXAMPLE 4

Thirty (30) parts of dolomite powder (dimension of 200 mesh and below), 25 parts of kieselguhr powder (3–15μ diameter), 30 parts of CMC-Na having D.S. of 0.48 and D.P. of 400 (trademark "CELLOGEN FC"; mfd. by Daiich Kogyo Seiyaku Co., Ltd.), 1 part of activated carbon, 7 parts of glycerin and about 270 parts of water are mixed to make the whole into a slurry. This slurry is spread on a steel plate in a thickness of about 0.5 mm, and after dried at the temperature of 80° C. in a hot-air drier to reduce the moisture content to about 9%, the spread material is stripped from the steel plate to obtain the tobacco substitute (i.e., control sample). A portion of the control sample is heated further at 200° C. for 10 minutes in the hot-air drier to reduce the moisture content to 0.9% (i.e., sample of the invention).

The sample of the invention and control sample are subjected, after being moisture-conditioned, to the tests of water-resistance, breaking strength, filling capacity and organoleptic properties, the results of which tests are shown in Tables 13–15.

Table 13

| | Thickness (mm) | Water-resistance (min.) |
|---|---|---|
| Control sample | 0.12 | 1.5 |
| Sample of the invention | 0.12 | 32.3 |

Table 14

| | Breaking strength (%) | Filling capacity (g/cigarette) |
|---|---|---|
| Control sample | 82 | 1.07 |
| Sample of the invention | 84 | 1.04 |

Table 15

| | Aroma | Taste | Mildness |
|---|---|---|---|
| Number of person(s) who praised cigarette by control sample | 1 | 0 | 2 |
| Number of person(s) who praised cigarette by sample of the invention | 1 | 3 | 1 |
| Number of person(s) who found no difference between two cigarettes | 18 | 17 | 17 |

From the results of Tables 13–15, it is revealed that the tobacco substitute heating-processed by the method of the present invention is significantly superior to the conventional tobacco substitute, in the water-resistance, and that the both tobacco substitutes are equivalent to each other in the physical properties except water-resistance, such as breaking strength and filling capacity, as well as the organoleptic properties.

What we claim is:

1. Method of processing smoking composition having an equilibrium value to improve the water-resistance of the same which comprises:

(a) admixing CMC-Na with natural tobacco material and/or either organic or inorganic material each of which is combustible, (b) forming the mixture resulting from step (a) into a sheet-like or rod-like shape so as to prepare a conventional smoking composition, (c) heating the conventional smoking composition prepared in step (b) at a temperature in the range of about 110°–240° C., whereby the moisture content of said composition is reduced to not more than 1%, and (d) returning the moisture content of the smoking composition heating-processed at step (c) to the equilibrium value.

2. Method as claimed in claim 1 wherein the temperature of heat-processing in step (c) is a temperature in the range of from about 150°–200° C.

3. Method as claimed in claim 2 wherein the time of heat-processing is a time in the range of from about 60-10 minutes.

4. Method as claimed in claim 1 wherein the time of heat-processing at step (c) is a time in the range of from about 120–5 minutes.

5. Method as claimed in claim 1 wherein the smoking composition heating-processed in step (c) is immediately humidified to return the moisture content of said composition to the equilibrium value in the atmosphere (7–12%).

6. Method as claimed in claim 1 wherein the smoking composition heating-processed in step (c) is left in the atmosphere without humidification whereby the moisture content of said composition is returned to the equilibrium value in the atmosphere (7–12%).

7. Method as claimed in claim 1 wherein the smoking composition which is heating-processed in step (c) and the moisture content of which is returned to equilibrium value in the atmosphere (7–12%) and is cut into chip-shape and used in the production of smoking products.

8. Method as claimed in claim 1 wherein the conventional smoking composition prepared in step (b) is, after having been cut into chip-shape, heating-processed in the same manner as in step (c), followed by returning the moisture content of said composition to equilibrium value, in the atmosphere (7–12%) and then used in the production of smoking products.

9. Method as claimed in claim 1 wherein the degree of polymerization of CMC-Na is in the range of from about 200–1000 and that of substitution by either groups is not greater than 1.0.

10. Method as claimed in claim 1 wherein other binders than CMC-Na are used together with CMC-Na.

11. Method as claimed in claim 10 wherein said other binders than CMC-Na incude one member selected from the group consisting of methyl cellulose, ethyl cellulose, hydroxyethyl cellulose, methylhydroxyethyl cellulose, ethylhydroxyethyl cellulose, methyl starch, ethyl starch, hydroxyethyl starch, carboxymethyl starch, tragacanth gum, locust bean gum, guar gum, gum arabic, dextran, alginic acids, pectins and salts thereof, and polyvinyl alcohol.

12. Method as claimed in claim 1 wherein said composition includes at least one member of the group consisting of a humectant, a burning regulator, a reinforcing agent, a flavorant and a taste improver as adjuvants in the preparation of a conventional smoking composition.

13. Method as claimed in claim 11 wherein the humectant comprises at least one member selected from the group consisting of ethyleneglycol, diethleneglycol, triethyleneglycol, tetraethyleneglycol, propyleneglycol, butyleneglycol, glycerin and sorbitol.

14. Method as claimed in claim 11 wherein the burning regulator comprises at least one member selected from the group consisting of potassium salts, ammonium salts, calcium salts and alumina.

15. Method as claimed in claim 11 wherein the reinforcing agent comprises at least one member selected from the group consisting of pulp, glass fibre, silicagel, kieselguhr, asbestos and bentonite.

16. Method as claimed in claim 11 wherein the flavorant comprises at least one member selected from the group consisting of licorice extract, cocoa, tonka bean and fruit extract.

17. Method as claimed in claim 11 wherein the taste improver comprises at least one member selected from the group consisting of sucrose, invert sugar, glucose, fructose, lactose, maltose, malic acid, citric acid, tartaric acid, salts of said acids, and amino acids.

* * * * *